US008782940B1

(12) United States Patent
Morris

(10) Patent No.: US 8,782,940 B1
(45) Date of Patent: Jul. 22, 2014

(54) REPLACEMENT GUNSTOCK

(76) Inventor: Gary D. Morris, Elizabethtown, IL (US)

( * ) Notice: Subject to any disclaimer, the term of this patent is extended or adjusted under 35 U.S.C. 154(b) by 97 days.

(21) Appl. No.: 13/560,004

(22) Filed: Jul. 27, 2012

Related U.S. Application Data

(60) Provisional application No. 61/512,194, filed on Jul. 27, 2011.

(51) Int. Cl.
*F41A 19/00* (2006.01)

(52) U.S. Cl.
USPC ..... 42/69.01; 42/71.01

(58) Field of Classification Search
CPC ..... F41C 23/00; F41C 23/16; F41A 19/08; F41A 19/09; F41A 19/10; F41A 19/15; F41A 11/02
USPC ..... 42/69.01, 69.02, 69.03, 71.01, 72, 42/75.01, 75.02, 75.03; 89/136
See application file for complete search history.

(56) References Cited

U.S. PATENT DOCUMENTS

| | | | | |
|---|---|---|---|---|
| 201,524 | A | 3/1878 | Henry et al. | |
| 1,344,991 | A * | 6/1920 | Cunningham | 89/144 |
| 1,386,247 | A | 8/1921 | Fordyce | |
| 3,188,763 | A * | 6/1965 | Duncan | 42/16 |
| 3,488,488 | A | 1/1970 | Crouch | |
| 3,512,290 | A | 5/1970 | Veolette, Jr. et al. | |
| 3,842,527 | A * | 10/1974 | Low | 42/75.02 |
| 4,296,564 | A | 10/1981 | Oberst | |
| 4,463,654 | A | 8/1984 | Barnes et al. | |
| 4,562,659 | A * | 1/1986 | Neta | 42/75.03 |
| 4,601,123 | A | 7/1986 | Swearengen et al. | |
| 4,677,781 | A | 7/1987 | Lee | |
| 4,869,008 | A | 9/1989 | Rasmussen | |
| 4,890,405 | A * | 1/1990 | Krouse | 42/75.03 |
| 5,018,292 | A | 5/1991 | West | |
| 6,301,817 | B1 * | 10/2001 | Hogue et al. | 42/71.01 |
| 6,526,683 | B1 | 3/2003 | Crandall | |
| 7,356,958 | B2 | 4/2008 | Weir | |
| 7,448,307 | B1 * | 11/2008 | Dafinov | 89/191.01 |
| 7,493,718 | B2 * | 2/2009 | Gorzen | 42/74 |
| 2004/0244261 | A1 * | 12/2004 | Roh | 42/106 |
| 2009/0211140 | A1 * | 8/2009 | Rolfe | 42/71.01 |
| 2011/0099875 | A1 * | 5/2011 | Bentley | 42/75.01 |
| 2011/0283582 | A1 * | 11/2011 | Hunter et al. | 42/69.02 |
| 2013/0185975 | A1 * | 7/2013 | Johnson | 42/69.02 |

* cited by examiner

*Primary Examiner* — Gabriel Klein
(74) *Attorney, Agent, or Firm* — Grace J. Fishel

(57) ABSTRACT

A replacement gunstock for shortening the overall length of a firearm with a barrel and breech mechanism and a separately attached trigger assembly. The replacement gunstock has a forehand portion with an elongated, hollowed-out depression through which a firing rod passes interconnecting the trigger in the trigger assembly with a sear mechanism in the breech.

15 Claims, 11 Drawing Sheets

REPLACEMENT GUNSTOCK

This application claims priority from provisional application Ser. No. 61/512,194, filed Jul. 27, 2011, for Apparatus and Method of Relocation of Trigger Mechanisms on Firearms.

BACKGROUND OF THE INVENTION

1. Field of the Invention

The present invention relates to a replacement gunstock for use in shortening the overall length of a rifle having a trigger assembly separate from the barrel and breech mechanism.

2. Brief Description of the Prior Art

There are occasions when the overall length of a rifle makes it too long for a particular application, for example when hunting. One solution is to remove part of the length of the rifle barrel to increase the maneuverability of the rifle and decrease the overall weight but there are federal and local laws that make short-barreled rifles illegal. Additionally reducing the length of the barrel also affects the power and accuracy of the weapon.

There are gunstocks for shortening the length of a rifle, commonly called "bull-pups." These devices typically involve a secondary trigger mounted in front of the original trigger with a mechanical link therebetween. Bull-pups require extensive disassembly of the rifle for insertion into the bull-pup module and an exact linkage of the two triggers. Adjustments tend to be difficult or impossible and "slop" in the linkage can lead to poor trigger action or misfire. Auxiliary equipment such as scopes, lasers and the like must be removed from the rifle and reattached to the bull-pup module after the other parts have been reassembled in the module thus requiring an additional step which may also affect accuracy.

In some rifles the barrel and breech mechanism and the trigger assembly are attached to the gunstock with separate fasteners. Such rifles are sold by Marlin and are available in a number of variations such as Model 60, Model 795 and Model 70P. Since all the aforementioned models are variations on the Model 60 and have similar separate trigger mechanisms and other features in common, the conversion disclosed herein is equally applicable to any of these models, as well as other makes of guns having similar trigger mechanisms.

BRIEF SUMMARY OF THE INVENTION

In view of the above, it is an object of the present invention to provide a replacement gunstock for use in shortening the overall length of a rifle that does not require major disassembly of the firearm. It is another object to provide a gunstock that does not require removal of auxiliary equipment from the barrel for attachment to the replacement gunstock. It is also an object to provide a replacement gunstock which allows the rifle to be brought into shooting position and fired one-handed. Other objects and features of the invention will be in part apparent and in part pointed out hereinafter.

In accordance with the invention a replacement gunstock is provided for use in shortening the overall length of a firearm. The firearm is of the kind having a barrel and breech mechanism and a separate trigger assembly which are removable from an original stock by releasing screws. The trigger assembly has a trigger with a finger on an upper end adapted to release a sear mechanism in the breech causing the gun to fire when the trigger is pivoted in the trigger assembly.

The replacement gunstock has a forehand portion and a butt with the forehand portion having an elongated, hollowed-out depression in its upper side for enclosing a portion of the barrel and breech mechanism. A pistol grip is attached to the lower side of the forehand portion a distance from the butt such that a user can support the gunstock griping the pistol grip with one hand while placing the butt of the gunstock against the shoulder of the same arm. An aperture is provided on the lower side of the forehand portion for mounting the trigger assembly immediately in front of the pistol grip whereby a forefinger of the hand gripping the pistol grip and supporting the gunstock may be utilized to actuate a trigger in the trigger assembly. A firing rod is housed in the hollowed-out depression with a first end for connection to the finger on the upper end of the trigger and a second end with an upstanding finger for releasing the sear mechanism. A channel is provided in the hollowed-out depression for routing the firing rod around a clip if the firearm has a clip magazine.

In use the barrel and breech mechanism and the trigger assembly may be unscrewed from the original stock and mounted on the replacement gunstock with the original screws. When the trigger is pulled, the upstanding finger on the firing rod releases the sear mechanism causing the weapon to fire in an ordinary manner. A storage compartment may be provided in the butt for ammunition, tools and like and a cavity may be provided in the pistol grip for storage of a spare clip.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
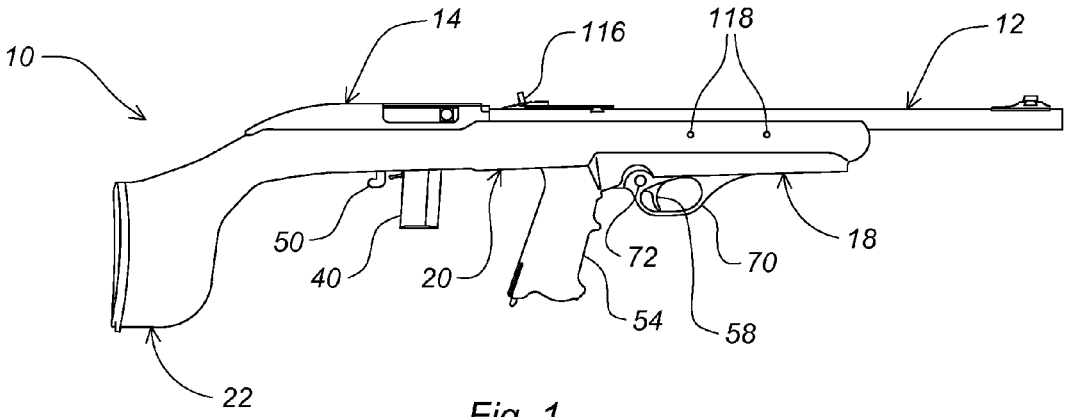
FIG. 1 is side elevation of a Marlin .22 caliber semi-automatic rifle with a clip, Model 795, mounted in a gunstock with a butt and forehand portion in accordance with the present invention.
Figure 2:
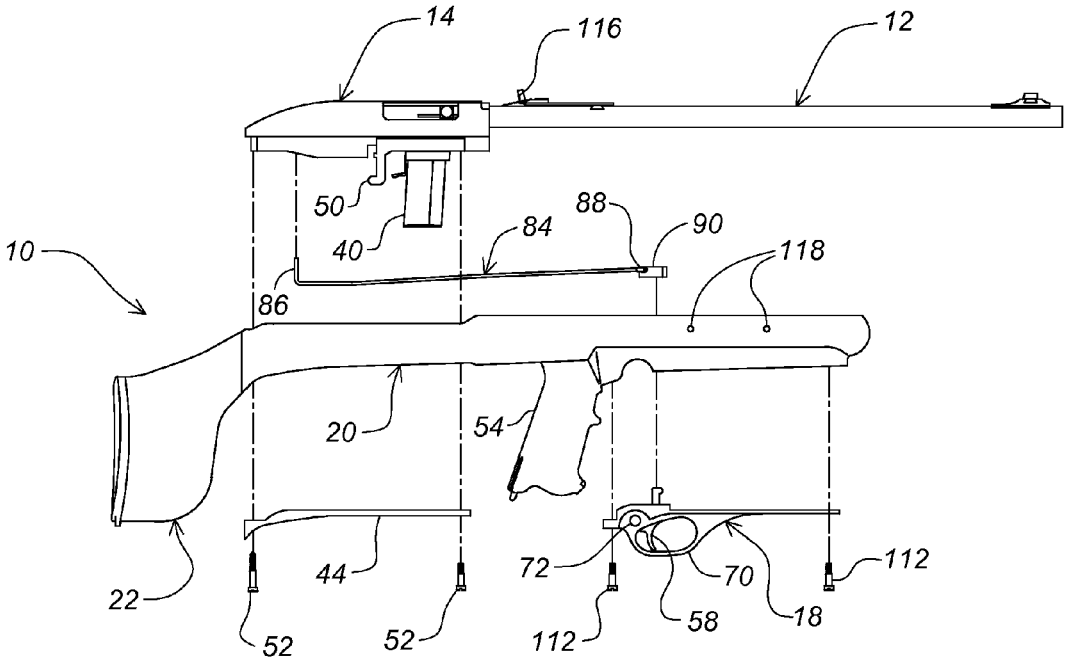
FIG. 2 is an exploded side elevation of the Model 795 unscrewed from the gunstock.
Figure 3:
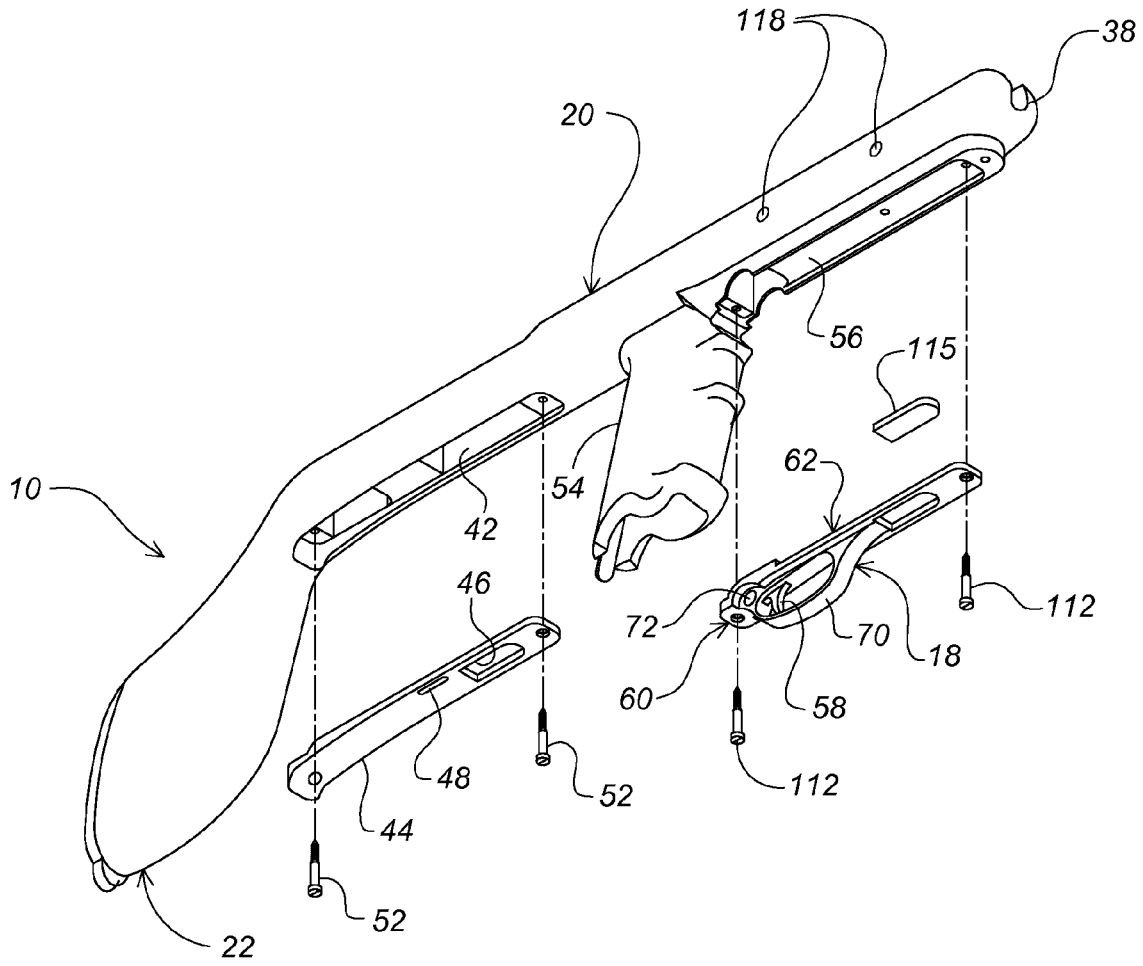
FIG. 3 is an exploded perspective view showing the lower side of the forehand portion and a first style trigger assembly.
Figure 4:
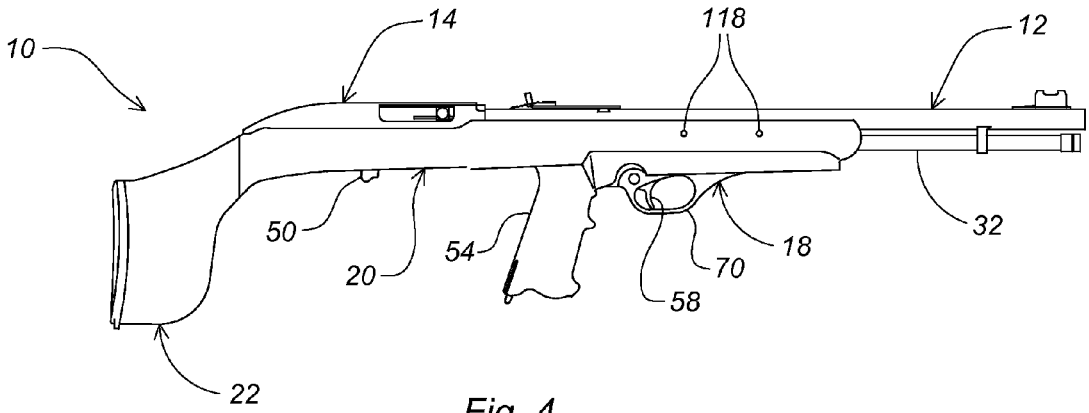
FIG. 4 is a side elevation of a Marlin .22 caliber semi-automatic tubular fed rifle, Model 60, mounted on the gunstock.

Referring to the drawings more particularly by reference character, a replacement gunstock 10 in accordance with the present invention is illustrated in use with several different models of Marlin .22 caliber semi-automatic rifles. Various features have been designed into gunstock 10 to accommodate the different models, the underlying common characteristic being that a barrel 12 and breech mechanism 14 and a trigger assembly 18 are attached to the gunstock with separate fasteners as described below.

Figure 7:
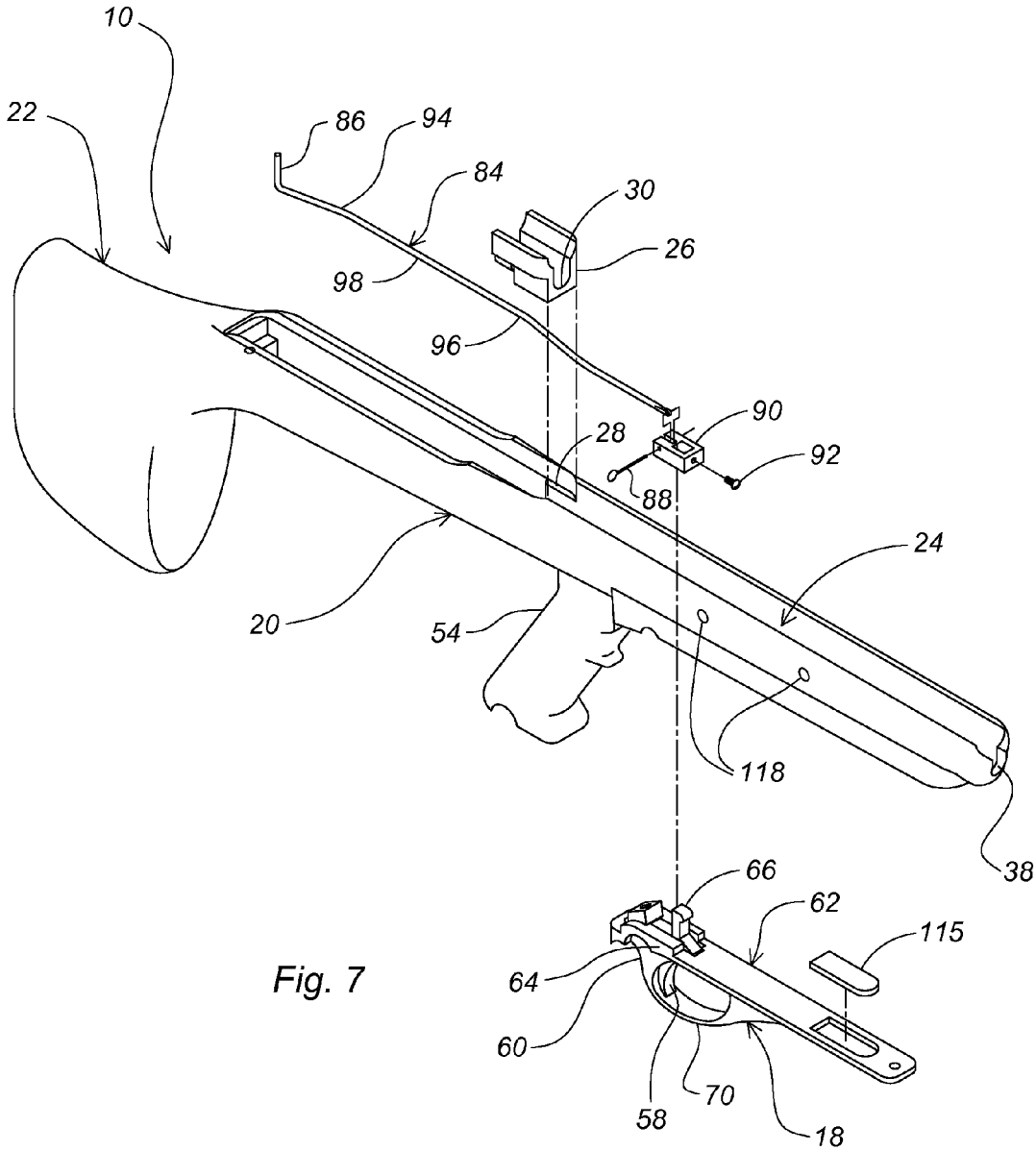
FIG. 7 is an exploded perspective view showing an elongated hollowed-out depression in an upper side of the forehand portion and assembly details of a trigger rod to a finger on an upper end of the trigger together with a removable shoe for fitting the depression to barrels of different rifles.
Figure 8:
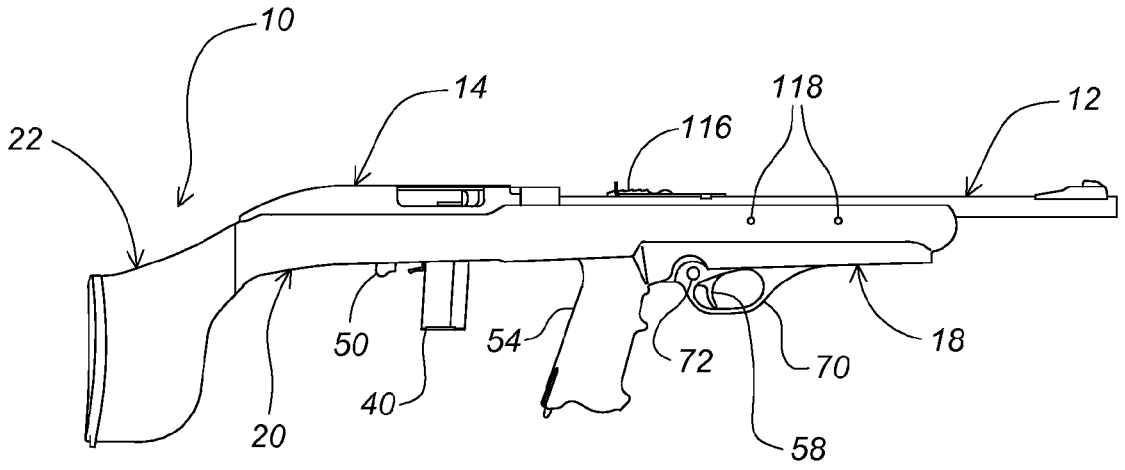
FIG. 8 is a side elevation of a Marlin .22 caliber semi-automatic rifle with a clip, Model 70P, mounted on the gunstock with the cradle shown in FIG. 7 removed to accommodate a ferrule for attaching the barrel to the breech mechanism.
Figure 9:
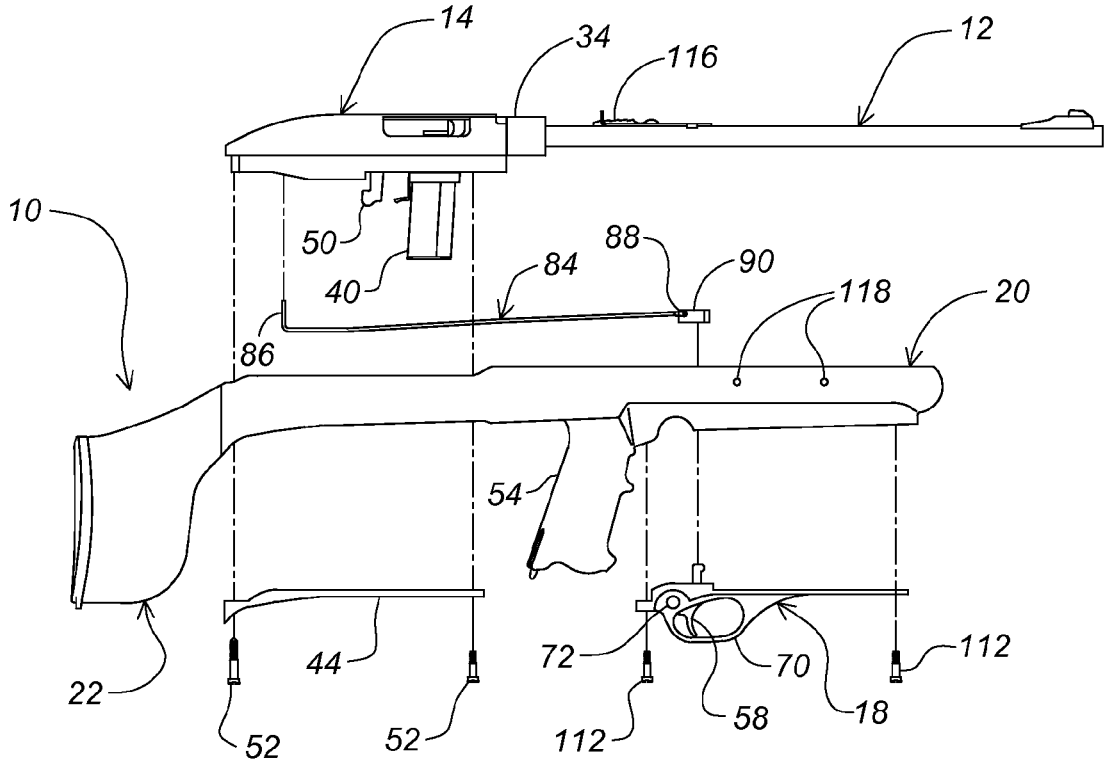
FIG. 9 is an exploded side elevation of the Model 70P unscrewed from the gunstock.
Figure 10:
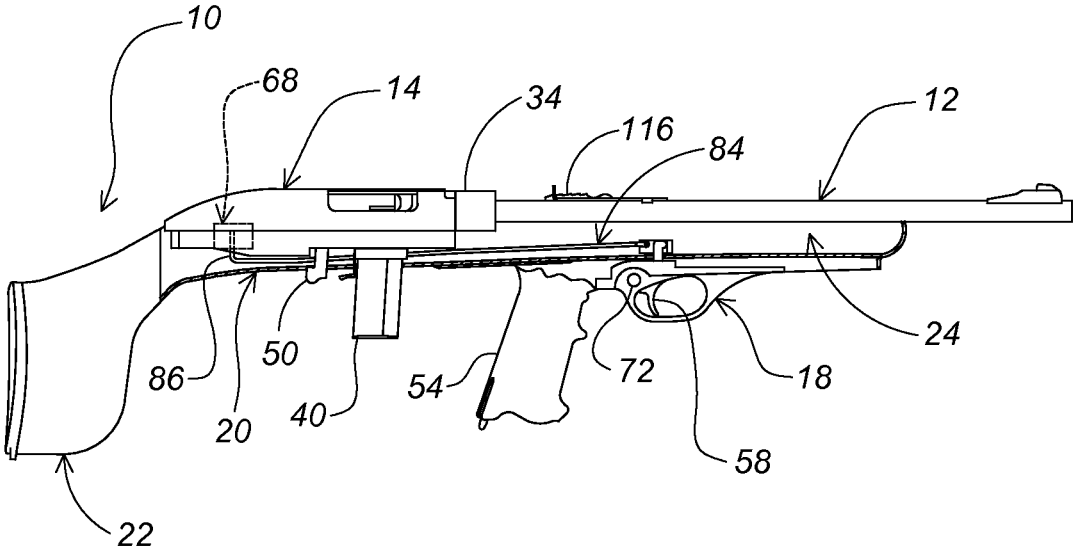
FIG. 10 is a side elevation of the Model 70p with the forehand sidewall broken away to show the connection between the trigger rod, trigger and sear mechanism in first position before the trigger is pulled.
Figure 11:
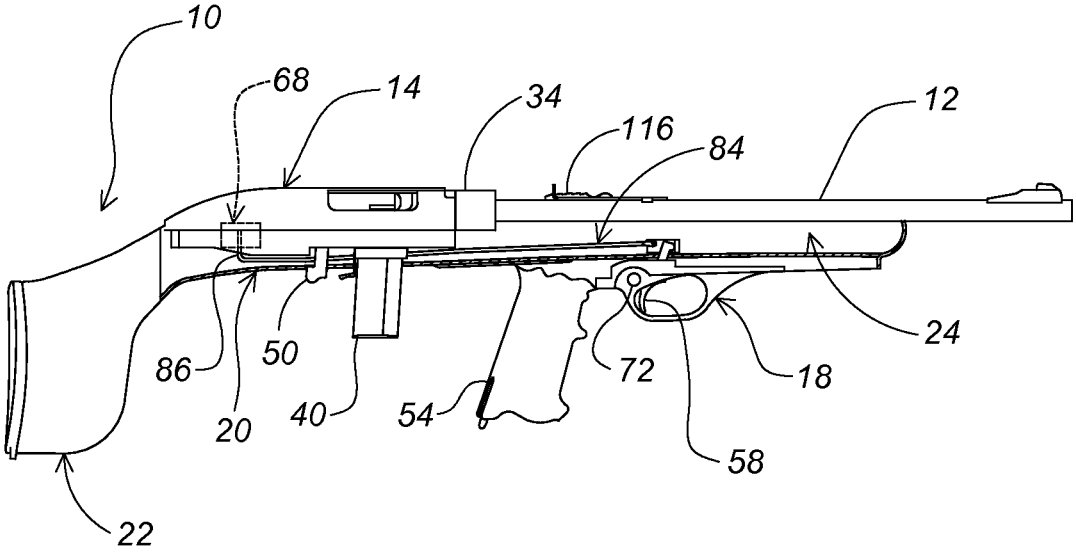
FIG. 11 is a side elevation of the Model 70p showing the trigger rod, trigger and sear mechanism in second position after the trigger is pulled.
Figure 12:
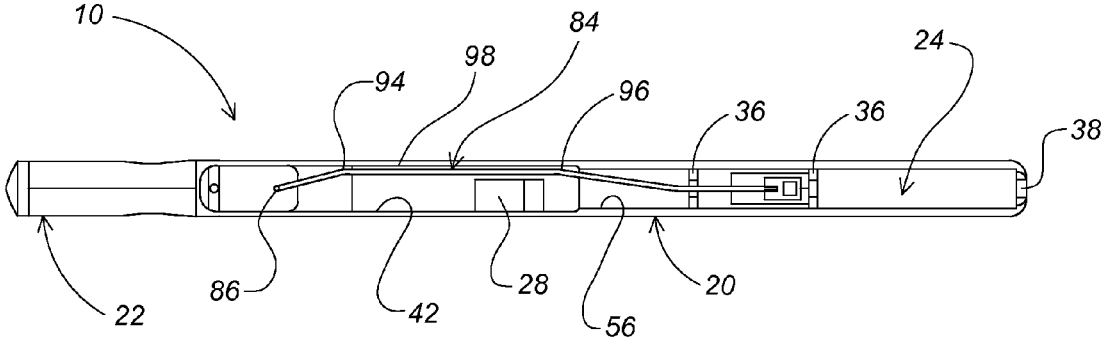
FIG. 12 is top plan view of the forehand portion showing the routing of the firing rod around an aperture for a clip.

As shown, gunstock 10 has a forehand portion 20 and a butt 22. Gunstock 10 is preferably of a molded plastic construction but may be made of wood or other suitable materials. The forehand portion 20 has an elongated, hollowed-out depression 24 in its upper side for enclosing a portion of barrel 12 and breech mechanism 14. A shoe 26 (FIG. 7) with a generally U-shaped cavity 30 is seated on a base 28 in depression 24. The profile of U-shaped cavity 30 is such that it cups the lower side of barrel 12 whether the gun is tube fed or not. For use with Model 70P, shoe 26 is removed to accommodate a ferrule 34 for detachable barrel 12. As seen in FIG. 12, several fins 36 with U-shaped cavities provide addition barrel 12 support in depression 24. A notch 38 at the front end of forehand portion 20 is shaped to accommodate a tubular fed magazine 32 (Model 60) as well as barrel 12 of Models 795 and 70P which are clip fed.

An aperture 42 is provided in a lower side of forehand portion 20 adjacent butt 22 to accommodate clip 40 on those models (Model 795 and 70P) which are clip fed. A cover plate 44 is provided for sealing aperture 42. Cover plate 44 has a first slot 46 through which a lower end of clip 40 passes and a second slot 48 through which a bolt release lever 50 passes. Fasteners such as screws 52 which attached breech mechanism 14 to the original stock may be used to attach the breech mechanism to gunstock 10 and at the same time attaching cover plate 44 to the lower side of the gunstock. A different cover plate (not shown) may be provided for use with rifles which are not clip fed and therefore do not require first slot 46 or a plug (not shown) may be provided for closing the slot and the same cover plate 44 used for all models.

Figure 17:
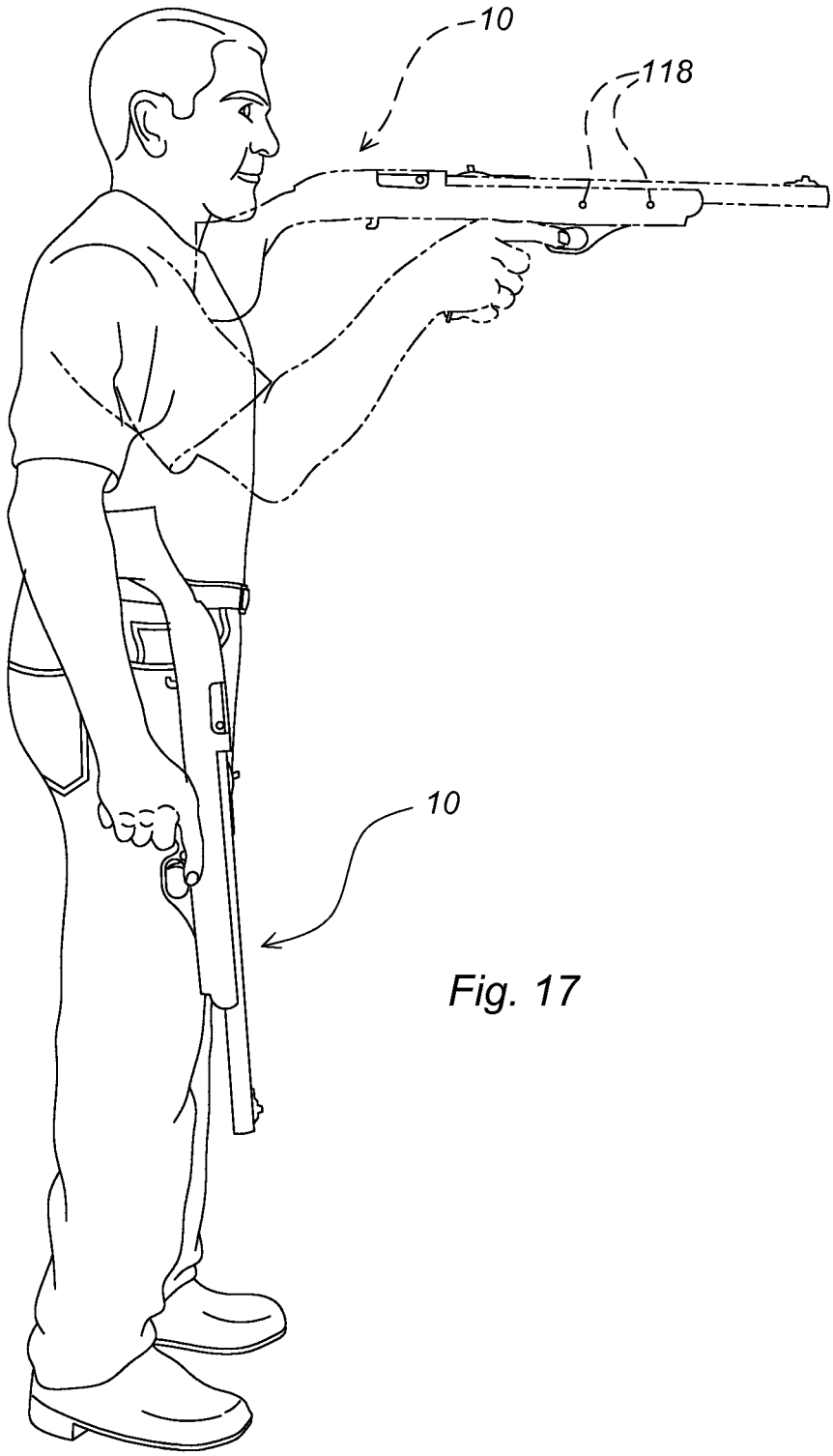
FIG. 17 is a side view of a user showing the gun as it can be carried or mounted on a shoulder strap in full lines and the gun raised with one hand into shooting position in broken lines.

A pistol grip 54 is attached to a lower side of forehand portion 20 in front of aperture 42 at a distance from butt 22 such that a user can support the gunstock griping the pistol grip with one hand while placing the butt of the gunstock against the shoulder of the same arm (FIG. 17). If gunstock 10 is for use by a younger user or by a woman, the distance between pistol grip 54 and butt 22 may be shorter. Another aperture 56 is provided in lower side of forehand portion 20 immediately in front of pistol grip 54 whereby a forefinger of a user's hand gripping the pistol grip and supporting the gunstock may be utilized to actuate a spring biased trigger 58.

Figure 18:
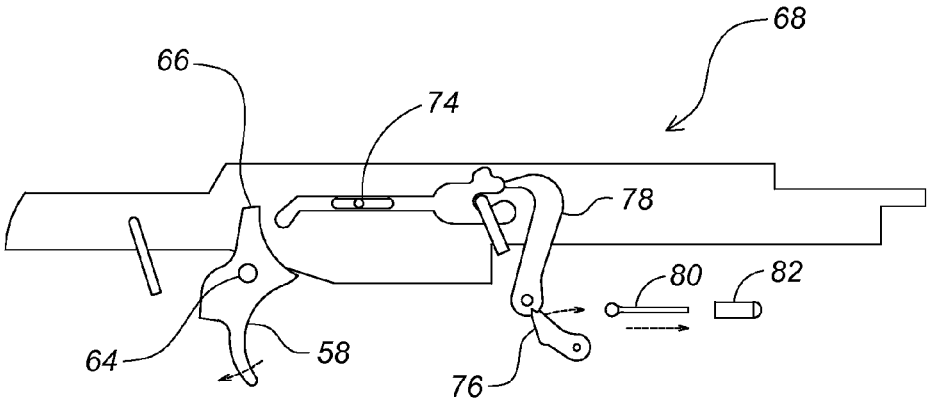
Fig. 18 (Prior Art)
FIG. 18 is schematic drawing showing a prior art manner in which a sear mechanism causes a weapon to fire in response to movement of a trigger; and, FIG. 19 is a schematic drawing showing a firing rod with an upstanding finger for releasing the sear mechanism in accordance with the present invention.
Figure 19:
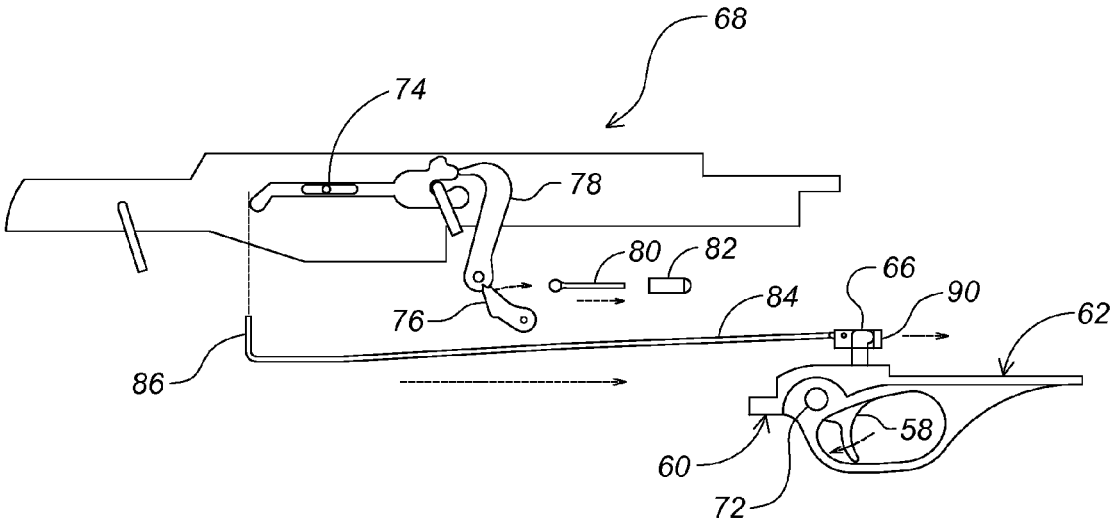

Trigger 58 is part of trigger assembly 18 which includes a case 60 attached to a plate 62. Case 60 includes side cheeks (FIG. 7) between which trigger 58 is pivoted 64 (FIG. 18). An upper end of trigger 58 includes a finger 66 which on an original stock actuates a sear mechanism 68 as shown in FIG. 18. Trigger assembly 18 includes a trigger guard 70 and a safety 72. In Safe position, a stop locks trigger 58 against pivotal movement. In a Fire position, trigger 58 is allowed to pivot upwardly thereby moving finger 66 forwardly. Trigger 58 is urged towards a normal forward position by a trigger spring (not shown).

As shown in FIG. 18, sear mechanism 68 includes a disconnect slide 74 which is pushed forward by finger 66 of trigger 58 when trigger assembly 18 is installed on an original Marlin gunstock. In locked position a hammer 76 is retained in position by engagement with an edge of a sear 78. Disconnect slide 74 when pushed by finger 66 causes sear 78 to pivot which releases hammer 76. Hammer 76 causes a bolt (not shown) to release a firing pin 80 to strike a loaded round 82 and fire the weapon in a conventional manner Turning now to FIGS. 7, 10-11 and 19, a firing rod 84 transfers movement of trigger finger 66 to a second finger 86 which actuates sear mechanism 68 in the usual manner As shown second finger 86 may be a right angle bend at a first end of firing rod 84. A second end of firing rod 84 is pivoted 88 in a collar 90 fitted over the upper end of trigger finger 66. Collar 90 may be held in place with a set screw 92.

Base 28 upon which shoe 26 sits in depression 24 and fins 36 are notched for receipt of firing rod 84 such that is passes along the elongated depression without interference with barrel 12. Firing rod 84 may have several bends to allow it to be used with a clip fed magazine 40 or with a weapon having a tubular fed magazine 32. For this purpose firing rod 84 has two bends 94. 96 with a straight run 98 therebetween such that firing rod 84 is routed around first slot 46 through which clip 40 passes but begins and ends substantially on centerline of depression 24, said bends 94, 96 canceling each other. Shoe 26 when present retains firing rod 84 in the channel though base 28 and fins 36.

Figure 13:
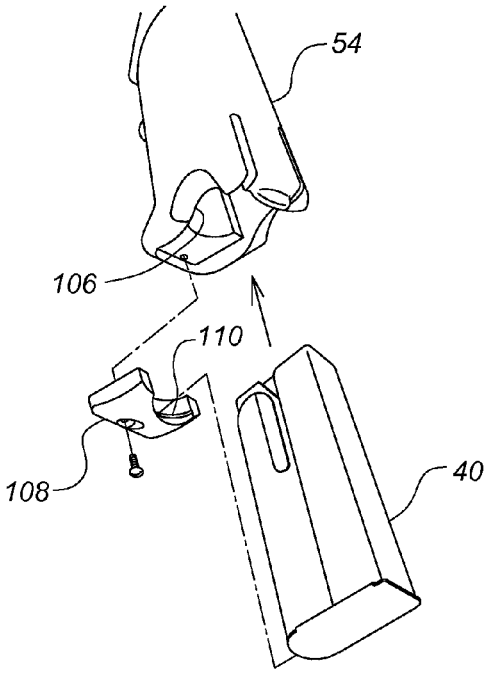
FIG. 13 is an exploded perspective view on an enlarged scale of the pistol grip with a cavity for an extra clip.
Figure 14:
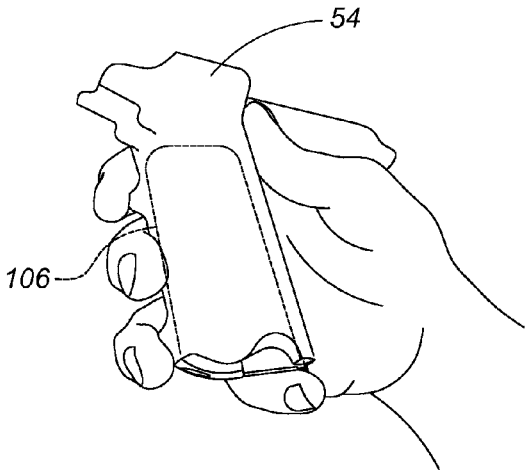
FIG. 14 is a side elevation of the pistol grip showing a user releasing the clip from the cavity.
Figure 15:
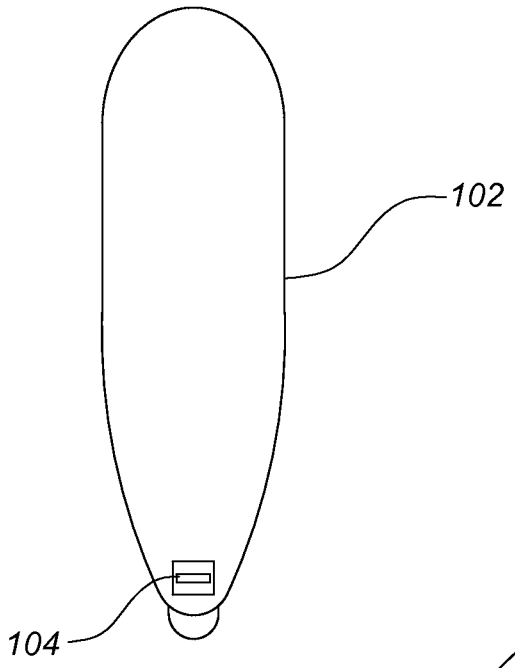
FIG. 15 is an end elevation of the butt on an enlarged scale with a storage compartment and an end cap attached.
Figure 16:
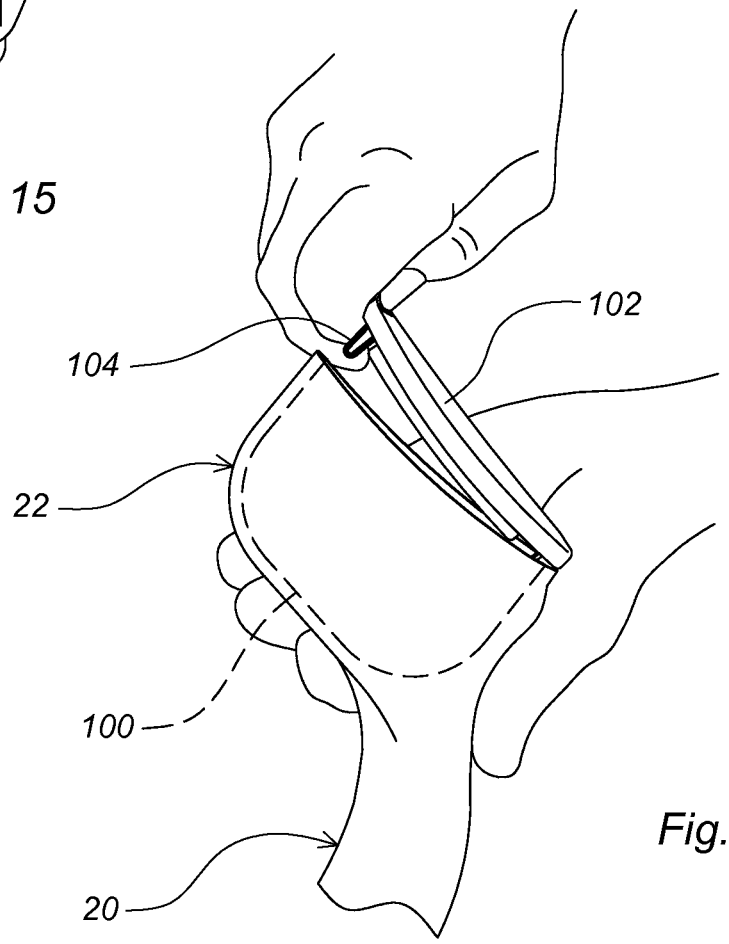
FIG. 16 is a side view of the butt showing a user removing the end cap.

Replacement gunstock 10 may include a storage compartment 100 for tools, whistle, extra ammunition and so forth. As seen in FIGS. 15-16, butt 22 may have a hollow cavity closed with an end cap 102 which is latched 104 into the end of butt 22. Pistol grip 54 may also have a hollow cavity 106 as shown in FIGS. 13-14 for receipt of an extra clip 40. A shoulder 108 at the base of pistol grip 54 may have a groove 110 into which the base of clip 40 is received. To release clip 40 from pistol cavity 106, an opposing sidewall of pistol grip 54 may be flexed (see FIG. 14) releasing the base of clip 40 from groove 110.

Figure 5:
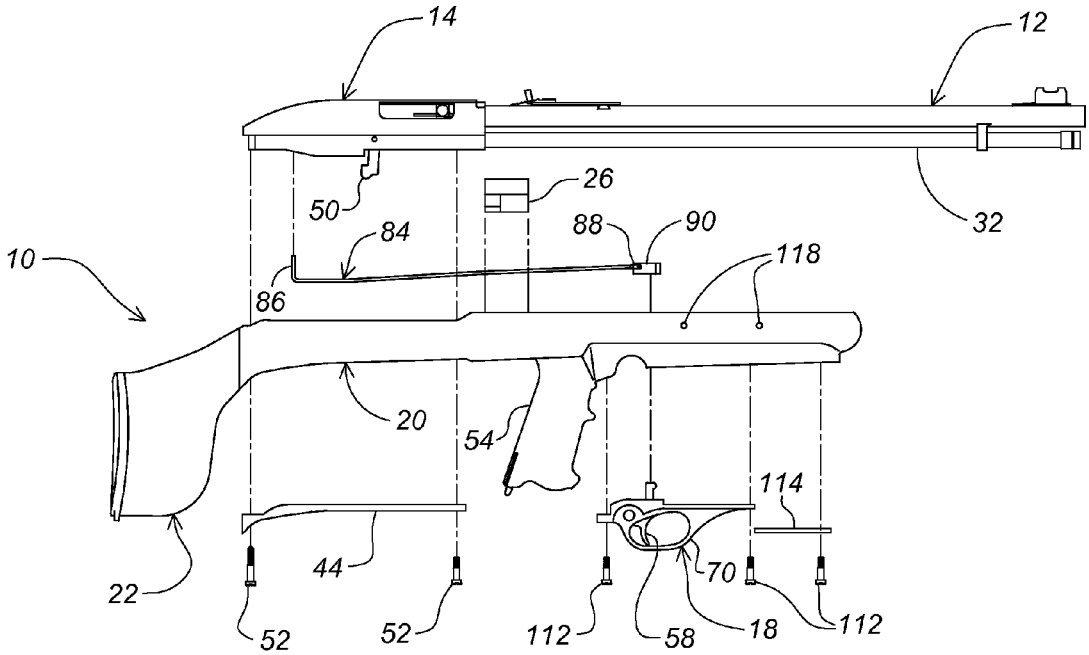
FIG. 5 is an exploded side elevation of the Model 60 unscrewed from the gunstock.
Figure 6:
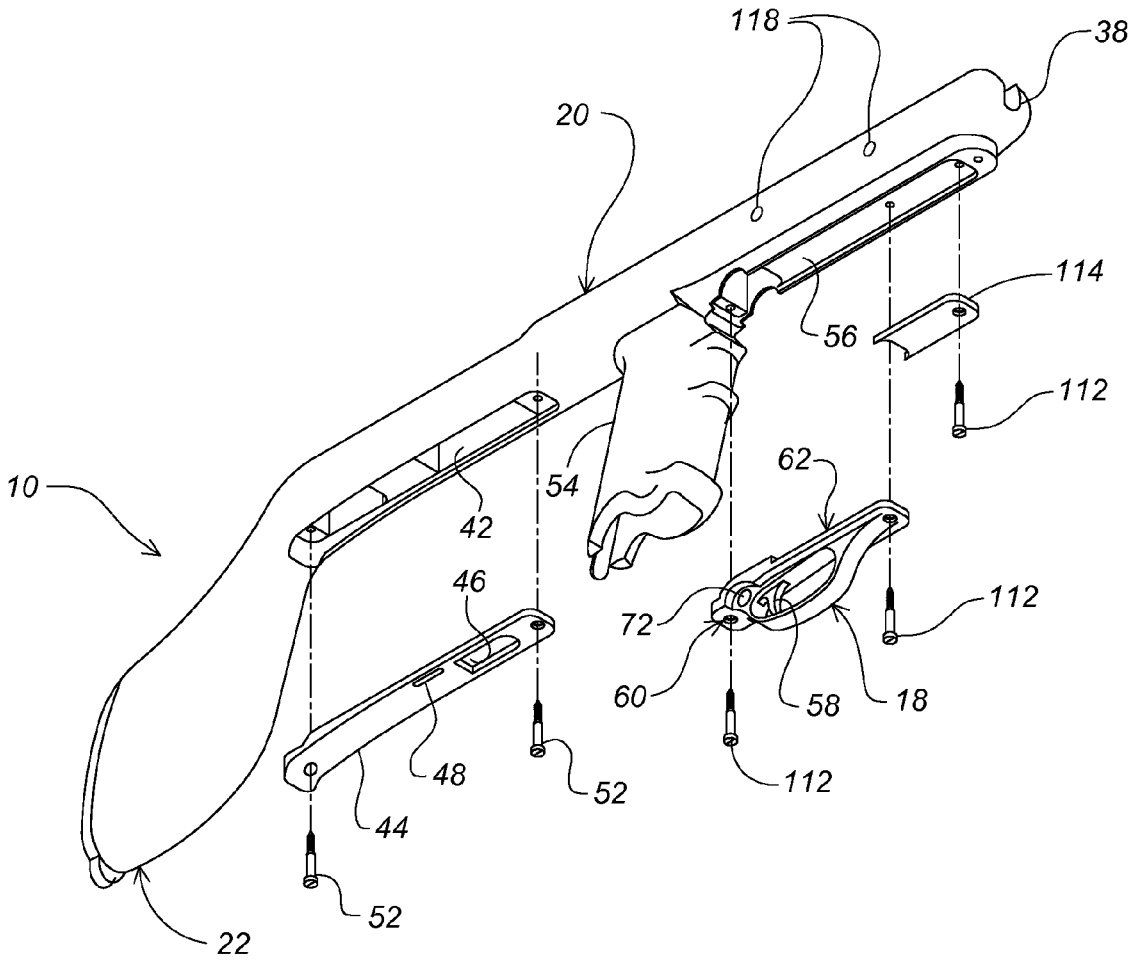
FIG. 6 is a exploded perspective view showing the lower side of the forehand portion and a second style trigger assembly.

In use, barrel 12 and breech mechanism 14 and trigger assembly 18 are dismounted from an ordinary gunstock such as comes as original equipment with a Marlin rifle and installed on replacement gunstock 10 as follows: Trigger assembly 18 is removed from the original gunstock by unscrewing fasteners 112. Trigger assembly 18 is fitted into aperture 56 of gunstock 10 with trigger finger 66 in hollowed-out depression 24 and then attached to replacement gunstock 10 with the same fasteners used to attach it to the original gunstock. As shown in the drawings aperture 56 is sized to accommodate trigger assemblies 18 of different length. As shown in FIGS. 5-6 with shorter trigger assemblies 18, a filler plate 114 may be provided and with other assemblies a plug 115 to fill the clip slot.

When firing rod 84 and collar 90 are provided as an assembled unit, collar 90 is slipped over trigger finger 66 and set screw 92 tightened. Shoe 26 (if present) is removed from depression 24 and firing rod 84 seated in the channel provided through base 28 and fins 36. Unless required for clearance of ferrule 34, shoe 26 is reinstalled on base 28 pinning firing rod 84 in the channel.

Barrel 12 and breech mechanism 14 is then dismounted from the original gunstock and inserted into depression 24 provided in the upper side of forehand portion 20 of gunstock 10. When firing rod 84 is installed in the channel as described above, finger 86 on firing rod 84 is received in the same area of sear mechanism 68 that the trigger finger 66 was previously received. A suitable cover plate 44 depending on whether the gun is tube fed or clip fed is selected and the same screws 52 used to mount barrel 12 and breech mechanism 14 to the original gunstock are used to attach them and the cover plate to gunstock 10.

The movement of barrel 12 and breech mechanism 14 and trigger assembly 18 between gunstocks is so easy that it can be done in the field. For that purpose a user may want to pack a screw driver or the like in storage compartment 100 in butt 22. It will also be apparent, that a red dot scope or the like mounted on barrel 12 need not be detached and is available for use on gunstock 10 without adjustment. An open sight 116 is also not affected. Any auxiliary equipment such as a flashlight, laser light and so forth may be attached to an outer wall of forehand portion 20 for which purpose a tactical rail (not shown) may be attached at 118.

As above described, when trigger 58 is pulled backward, trigger finger 66 rocks and pulls firing rod 84 forward and firing rod finger 86 actuates sear mechanism 68 as described above. The pull force on trigger 58 necessary to fire the weapon may be reduced and the accuracy of the firearm is unchanged. By shortening the length of the firearm and providing a pistol grip, the following advantages should be apparent: The rifle is easier for a user to carry, store in the back of a cab, climb trees, etc. and pistol grip 54 allows a user to move the weapon quickly with one hand into firing position which may permit him to make shots that he might otherwise miss because of timing.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A replacement gunstock for use in shortening the overall length of a firearm, said firearm having a barrel and breech mechanism and a separate trigger assembly, said trigger assembly having a trigger with a first upstanding finger on an upper end adapted to release a sear mechanism in the breech mechanism causing the gun to fire when the trigger is pivoted in the trigger assembly, said barrel and breech mechanism and said trigger assembly removable from an original stock of the firearm by releasing original screws, said replacement gunstock comprising a forehand portion and a butt, said forehand portion having an elongated, hollowed-out depression in its upper side for enclosing a portion of the barrel and breech mechanism, said forehand portion having pistol grip attached to its lower side a distance from the butt such that a user can support the gunstock gripping the pistol grip with one hand and placing the butt of the gunstock against the shoulder of the same arm, said forehand portion having a first aperture on the lower side for mounting the trigger assembly immediately in front of the pistol grip whereby a forefinger of the hand gripping the pistol grip and supporting the gunstock may be utilized to actuate a trigger in the trigger assembly, a firing rod in the hollowed-out depression with a first end having a collar pivotably attached thereto and a second end with a second upstanding finger for releasing the sear mechanism, said collar configured to be attached to said first upstanding finger to connect the trigger with the firing rod, whereby the barrel and breech mechanism and the trigger assembly may be unscrewed from the original stock and mounted on the replacement gunstock with the original screws, said second upstanding finger on the firing rod releasing the sear mechanism and firing the firearm in response to movement of the trigger.

2. The replacement stock of claim 1 wherein the forehand portion has a second aperture on the lower side between the butt and the pistol grip to accommodate a clip fed magazine to the breech mechanism.

3. The replacement stock of claim 2 wherein the firing rod has two bends with a straight run therebetween for routing the firing rod around the second aperture.

4. The replacement stock of claim 1 wherein a front end of the depression is notched to accommodate a firearm that has a tube fed magazine.

5. A replacement gunstock for use in shortening the overall length of a firearm, said firearm having a barrel and breech mechanism and a separate trigger assembly, said trigger assembly having a trigger with a finger on an upper end adapted to release a sear mechanism in the breech mechanism causing the gun to fire when the trigger is pivoted in the trigger assembly, said barrel and breech mechanism and said trigger assembly removable from the an original stock of the firearm by releasing original screws, said replacement gunstock comprising a forehand portion and a butt, said forehand portion having an elongated, hollowed-out depression in its upper side for enclosing a portion of the barrel and breech mechanism, said forehand portion having a plurality of fins with a U-shaped recess for cupping and supporting the barrel in the depression, said forehand portion having a base upon which is seated a removable shoe with a U-shaped recess for cupping and supporting the barrel in the depression, said fins and base notched to provide a channel for a firing rod, said forehand portion having pistol grip attached to its lower side a distance from the butt such that a user can support the gunstock gripping the pistol grip with one hand and placing the butt of the gunstock against the shoulder of the same arm, said forehand portion having a first aperture on the lower side for mounting the trigger assembly immediately in front of the pistol grip whereby a forefinger of the hand gripping the pistol grip and supporting the gunstock may be utilized to actuate a trigger in the trigger assembly, said forehand portion having a second aperture on the lower side between the butt and the pistol grip to accommodate a clip fed magazine, said firing rod having a first end for connection to the finger on the upper end of the trigger and a second end with an upstanding finger for releasing the sear mechanism, whereby the barrel and breech mechanism and the trigger assembly may be unscrewed from the original stock and mounted on the replacement gunstock with the original screws, said upstanding finger on the firing rod releasing the sear mechanism and firing the firearm in response to movement of the trigger.

6. The replacement gunstock of claim 5 wherein the butt has a storage compartment closed with an end cap.

7. The replacement gunstock of claim 5 wherein the pistol grip has a cavity for an extra clip fed magazine.

8. The replacement gunstock of claim 5 wherein a collar is attached to the finger on the upper end of the trigger and the first end of the firing rod is pivoted to the collar.

9. The replacement stock of claim 6 wherein the firing rod has two bends with a straight run therebetween for routing firing rod around the second aperture.

10. The replacement stock of claim 5 wherein a front end of the depression is notched to accommodate a firearm that has a tube fed magazine.

11. The replacement stock of claim 5 wherein a cover plate is provided for the second aperture, said cover plate attached to the replacement stock with the original screws for attaching the barrel and breech mechanism, said cover plate having a first slot through which a lower end of a clip magazine passes and a second slot through which a bolt release lever passes, said clip magazine and bolt release lever connected to the breech mechanism.

12. A replacement gunstock for use in shortening the overall length of a firearm, said firearm having a barrel and breech mechanism and a separate trigger assembly, said trigger assembly having a trigger with a finger on an upper end adapted to release a sear mechanism in the breech mechanism causing the gun to fire when the trigger is pivoted in the trigger assembly, said barrel and breech mechanism and said trigger assembly removable from an original stock of the firearm by releasing original screws, said replacement gunstock molded from plastic and comprising a forehand portion and a butt, said forehand portion having an elongated, hollowed-out depression in its upper side for enclosing a portion of the barrel and breech mechanism, said forehand portion having a plurality of fins with a U-shaped recess for cupping and supporting the barrel in the depression, said forehand portion having a base upon which is seated a removable shoe with a U-shaped recess for cupping and supporting the barrel in the depression, said fins and base notched to provide a channel for a firing rod, said forehand portion having pistol grip attached to its lower side a distance from the butt such that a user can support the gunstock gripping the pistol grip with one hand and placing the butt of the gunstock against the shoulder of the same arm, said forehand portion having a first aperture on the lower side for mounting the trigger assembly immediately in front of the pistol grip whereby a forefinger of the hand gripping the pistol grip and supporting the gunstock may be utilized to actuate a trigger in the trigger assembly, said forehand portion having a second aperture on the lower side between the butt and the pistol grip to accommodate a clip fed magazine, said firing rod having a first end for connection to the finger on the upper end of the trigger and a second end with an upstanding finger for releasing the sear mechanism, said firing rod having first and second bends with a straight run therebetween for routing firing rod around the second aperture, whereby the barrel and breech mechanism and the trigger assembly may be unscrewed from the original stock and mounted on the replacement gunstock with the original screws, said upstanding finger on the firing rod releasing the sear mechanism and firing the firearm in response to movement of the trigger.

13. The replacement gunstock of claim 12 wherein the butt has a storage compartment closed with an end cap.

14. The replacement gunstock of claim 12 wherein the pistol grip has a cavity for an extra clip fed magazine.

15. The replacement gunstock of claim 12 wherein a collar is attached to the finger on the upper end of the trigger and the first end of the firing rod is pivoted to the collar.

* * * * *